US006993262B2

(12) United States Patent
Nezu

(10) Patent No.: US 6,993,262 B2
(45) Date of Patent: Jan. 31, 2006

(54) FIXING APPARATUS

(75) Inventor: Yukihiro Nezu, Matsudo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 204 days.

(21) Appl. No.: 10/624,677

(22) Filed: Jul. 23, 2003

(65) Prior Publication Data

US 2004/0018023 A1 Jan. 29, 2004

(30) Foreign Application Priority Data

Jul. 24, 2002 (JP) ..... 2002-215776

(51) Int. Cl.
*G03G 15/20* (2006.01)

(52) U.S. Cl. ..... 399/33; 399/67

(58) Field of Classification Search ..... 339/33, 339/37, 67, 69, 88, 320, 328, 335; 219/216, 219/619, 667

See application file for complete search history.

(56) References Cited

U.S. PATENT DOCUMENTS

| | | | | | |
|---|---|---|---|---|---|
| 6,799,002 | B2 | * | 9/2004 | Birumachi | 399/67 |
| 2002/0005405 | A1 | * | 1/2002 | Sato et al. | 219/619 |
| 2002/0061198 | A1 | * | 5/2002 | Sameshima et al. | 399/68 |
| 2003/0053812 | A1 | | 3/2003 | Nakayama | |
| 2003/0155349 | A1 | * | 8/2003 | Matsuo et al. | 219/667 |
| 2004/0105693 | A1 | * | 6/2004 | Akizuki et al. | 399/69 |
| 2004/0179874 | A1 | * | 9/2004 | Kinouchi et al. | 399/328 |
| 2004/0222216 | A1 | * | 11/2004 | Kinouchi et al. | 219/619 |

* cited by examiner

*Primary Examiner*—G. Bradley Bennett
(74) *Attorney, Agent, or Firm*—Foley & Lardner LLP

(57) ABSTRACT

A coil for generating a high-frequency magnetic field is provided in a heating roller. The coil is connected to a capacitor, constituting a resonant circuit. The resonant circuit is incorporated in a high-frequency wave generating circuit. A current-detecting circuit detects the current supplied to the high-frequency wave generating circuit. The supply of the current to the high-frequency wave generating circuit is controlled in accordance with the current detected by the current-detecting circuit and the logic level of an operation-on signal.

14 Claims, 2 Drawing Sheets

FIXING APPARATUS

CROSS-REFERENCE TO RELATED APPLICATIONS

This application is based upon and claims the benefit of priority from the prior Japanese Patent Application No. 2002-215776, filed Jul. 24, 2002, the entire contents of which are incorporated herein by reference.

BACKGROUND OF THE INVENTION

1. Field of the Invention

The present invention relates to a fixing apparatus designed for use in an image forming apparatuses such as copiers or printers and configured to fix developer images on paper sheets.

2. Description of the Related Art

Any image forming apparatus utilizing digital technology, such as an electronic copier, comprises a fixing apparatus. The fixing apparatus has a heating roller and a pressing roller. The pressing roller contacts the heating roller. A paper sheet with a toner image on it can be fed forward through the nip between the heating roller and the pressing roller. As the sheet is so fed, the toner image is fixed on the paper sheet by virtue of the heat generated by the heating roller.

The heating roller generates heat by means of induction heating achieved by a high-frequency magnetic field. The heating roller incorporates a coil and a capacitor connected to the coil. The coil and capacitor constitute a resonance circuit. When the resonance circuit is excited, a high-frequency current flows in the coil. As the current flows in the coil, the coil generates a high-frequency magnetic field. The magnetic field induces an eddy current in the heating roller. The heating roller generates Joule heat from the eddy current.

In any fixing apparatus that performs induction heating is performed, a thermostat is attached to the heating roller and is provided on the power-supply line that connects the fixing apparatus to the commercially available power supply. When the thermostat operates, the power-supply line is electrically cut and the induction heating stops. This prevents the heating roller from being heated to an excessive temperature.

The thermostat cannot operate the moment an excessive heating of the heating roller is detected. Rather, it starts with some time delay. Consequently, the heating roller and its neighboring components may be thermally influenced.

A part of the power line goes around the thermostat provided on the heating roller. This arrangement of the power line is undesirable in view of noise reduction and operation safety.

BRIEF SUMMARY OF THE INVENTION

An object of the present invention is to provide a fixing apparatus that excels in safety and reliability, in which an excessive temperature rise of the heating roller can be prevented, without any delay, without using a thermostat and without arranging the power line around any component.

A fixing apparatus according to this invention comprises: a heating member to be rotated to fix toner images; a coil which generates a high-frequency magnetic field to perform induction heating in the heating member; a high-frequency wave generating circuit which operates with power supplied from a power supply and which outputs a high-frequency current to the coil for generating the high-frequency magnetic field; a current-detecting unit which detects a current supplied from the power supply to the high-frequency wave generating circuit; a control unit which drives the high-frequency wave generating circuit when an operation-on signal for initiating the induction heating acquires a first logic high level and which stops the high-frequency wave generating circuit when the operation-on signal acquires a second logic level; and a protection circuit which controls supply of the current to the high-frequency wave generating circuit in accordance with the logic level of the operation-on signal and the magnitude of the current detected by the current-detecting unit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the present invention will be described with reference to the accompanying drawings.

An image forming apparatus according to this invention is, for example, an electronic copier. The copier comprises a scanning unit, a process unit, and a fixing apparatus. The scanning unit optically reads the image printed on an original. The processing unit (unit 95, described later) forms, on a paper sheet, a toner image corresponding to the image read by the scanning unit. The fixing apparatus (apparatus 100, described later) heats the paper sheet, thereby fixing the toner image on the paper sheet. The structure of this image forming apparatus is disclosed in U.S. patent application Ser. No. 09/955,089 and will not be described in detail.

Figure 1:
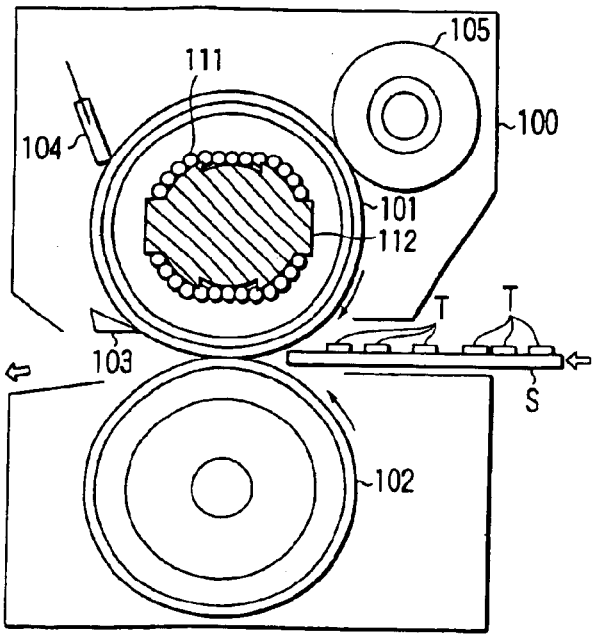
FIG. 1 is a diagram showing the major components of a fixing apparatus that is one embodiment of the invention.

FIG. 1 depicts the fixing apparatus 100. As shown in FIG. 1, the fixing apparatus 100 comprises a heating roller 101 and a pressing roller 102. The heating roller 101 is located above the copy-sheet path. The pressing roller 102 lies below the copy-sheet path and contacts the heating roller 101, pressed onto the roller 101 by means of a pressing mechanism (not shown). The contacting parts of the rollers 101 and 102 form a nip. The nip has a prescribed length.

The heating roller 101 comprises a hollow cylinder and a layer. The cylinder is made of electrically conductive material, for example iron. The layer is made of, for example, Teflon, and covers the outer circumferential surface of the hollow cylinder. The heating roller 101 can be rotated clockwise in FIG. 1. The pressing roller 102 can be rotated counter-clockwise. A copy sheet S may pass through the nip between the heating roller 101 and the pressing roller 102. While passing through the nip, the sheet S receives heat from the heating roller 101. The toner image T on the sheet S is thereby fixed.

A sheet-peeling claw 103, a cleaning member 104, and a release-agent applying roller 105 are arranged around the heating roller 101. The sheet-peeling claw 103 is designed to peel a copy sheet S from the heating roller 101. The cleaning member 104 is configured to remove residual toner, paper dust and the like from the heating roller 101. The release-agent applying roller 105 is provided to apply a release agent to the outer circumferential surface of the heating roller 101.

The heating roller 101 incorporates a coil 111 that performs induction heating. The coil 111 is wound and held around a core 112. It is designed to generate a high-frequency magnetic field to achieve induction heating. When the coil 111 generates a high-frequency magnetic field, an eddy current is induced in the heating roller 101. The roller 101 generates Joule heat from the eddy current.

The heating roller 101 that is used as a heating member can be replaced by a belt made of electrically conductive material. The coil 111 may be arranged outside the heating roller 101, not in the roller 101 as shown in FIG. 1.

Figure 2:
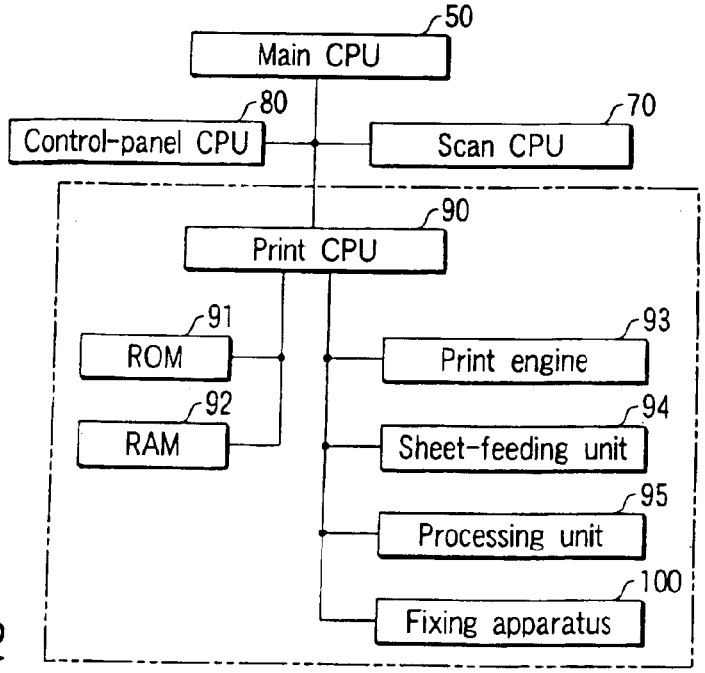
FIG. 2 is a block diagram of the control circuit incorporated in an electronic copier relating to the embodiment.

FIG. 2 shows the control circuit incorporated in the electronic copier according to the invention. As FIG. 2 shows, the control circuit comprises a main CPU 50, a scan CPU 70, a control-panel CPU 80, and a print CPU 90. The CPUs 70, 80 and 90 are connected to the main CPU 50.

A ROM 91, a RAM 92, a print engine 93, a sheet-feeding unit 94, a processing unit 95, and the fixing apparatus 100 are connected to the print CPU 90. The ROM 91 stores control programs. The RAM 92 is provided to store data.

Figure 3:
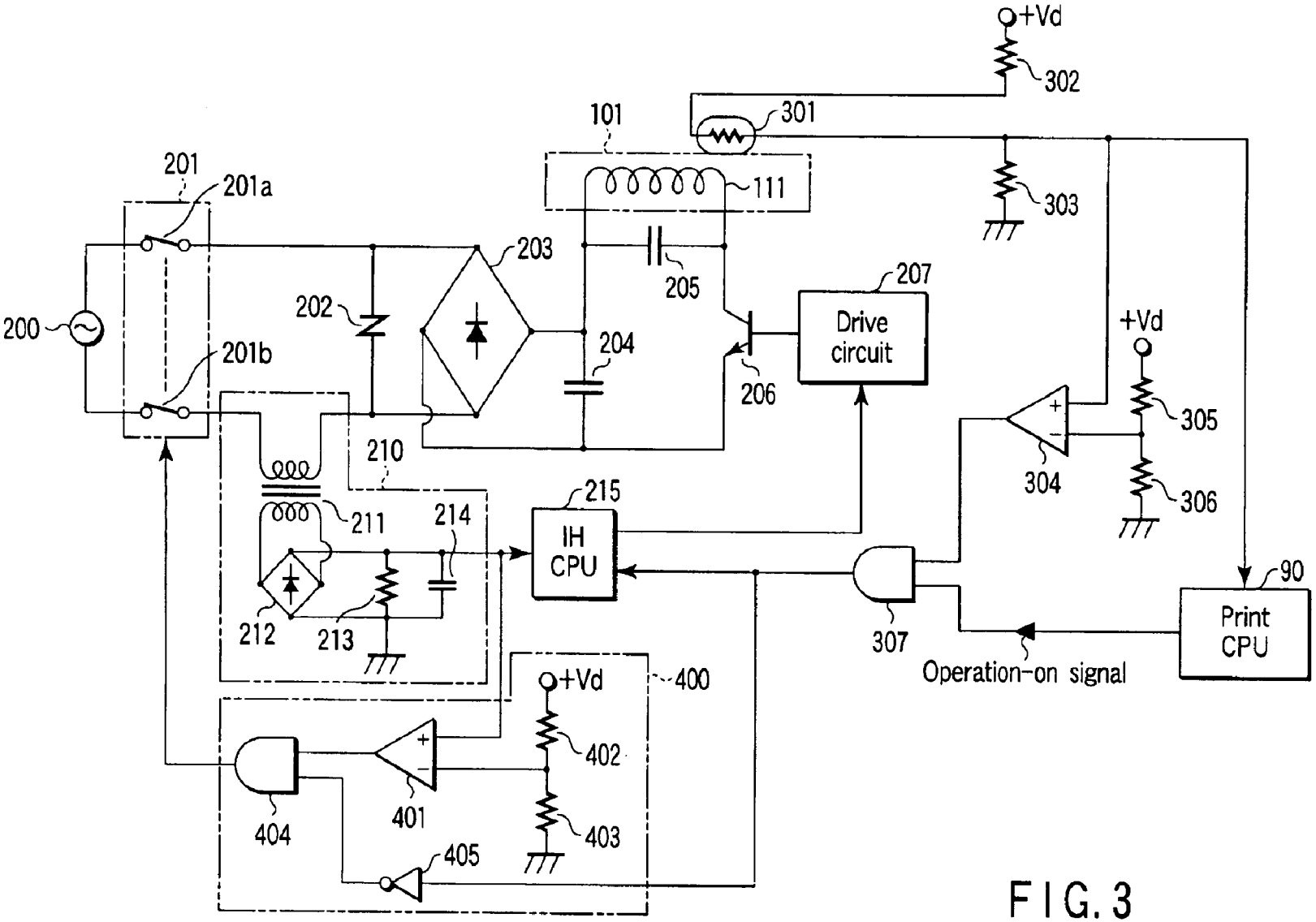
FIG. 3 is a block diagram of the electric circuit provided in the embodiment.

FIG. 3 depicts the electric circuit of the fixing apparatus 100. As FIG. 3 shows, a switch 201 having normally closed contacts 201*a* and 201*b* connects a variable resistor 202 and rectifying circuit 203 to the commercially available power supply 200. The output of the rectifying circuit 203 is connected to a smoothing capacitor 203. The smoothing capacitor 204 is connected to a resonant circuit that comprises the above-mentioned coil 111 and a capacitor 205. A switching element (transistor) 206 is provided on the current path to the resonant circuit to excite the resonant circuit. The switching element 206 is turned on or off by a drive signal supplied from a drive circuit 207. When the element 206 is turned on, the resonant circuit is excited, inducing a high-frequency current in the coil 111. As a result, the coil 111 generates a high-frequency magnetic field.

The variable resistor 202, rectifying circuit 203, smoothing capacitor 204, capacitor 205 and switching element 206 constitute a high-frequency wave generating circuit that supplies a high-frequency current to the coil 111. A current-detecting circuit 210 is provided on the current path (power-supply line) extending between the commercially available power supply 200 and the high-frequency wave generating circuit.

The current-detecting circuit 210 comprises a voltage-lowering transformer 211, rectifying circuit 212 and a parallel circuit. The transformer 211 has its primary winding connected to the current path to the high-frequency wave generating circuit. The rectifying circuit 212 is connected to the secondary winding of the transformer 211. The parallel circuit comprises a resistor 213 and a smoothing capacitor 214, both connected to the output of the rectifying circuit 212. The current-detecting circuit 210 outputs a DC voltage that corresponds to the current input to the high-frequency wave generating circuit. The DC voltage is applied to the IH CPU 215, which is a control unit.

The IH CPU 215 receives an output of the coil 111 from the current detected by the current-detecting circuit 210 while the operation-on signal supplied from the print CPU 90 remains at logic "1" level. The IH CPU 215 controls the drive circuit 207, which drives the high-frequency wave generating circuit so that the output of the coil 111 may remain at a predetermined value.

A temperature sensor 301 is mounted on the outer circumferential surface of the heating roller 101. The temperature sensor 301 receives a DC voltage Vd via resistors 302 and 303. Hence, the voltage generated across the resistor 303 rises as the temperature of the heating roller 101 rises, decreasing the resistance of the temperature sensor 301.

The voltage generated across the resistor 303 is applied to the print CPU 90 as a signal that represents the temperature the sensor 301 has detected.

The voltage generated across the resistor 302 is applied to the negative (−) input terminal of a comparator 304, too. The DC voltage Vd is applied to a series circuit comprising resistors 305 and 306. The voltage generated across the resistor 306 is applied as reference voltage to the positive (+) input terminal of the comparator 304. The output of the comparator 304 is at logic "1" level as long as the voltage generated across the resistor 303 remains lower than the reference voltage. It falls to logic "0" level when the voltage generated across the resistor 303 becomes equal to or higher than the reference voltage (or when the temperature of the heating roller 101 rises to excess). The output of the comparator 304 is input to one input terminal of an AND circuit 307.

Figure 4:
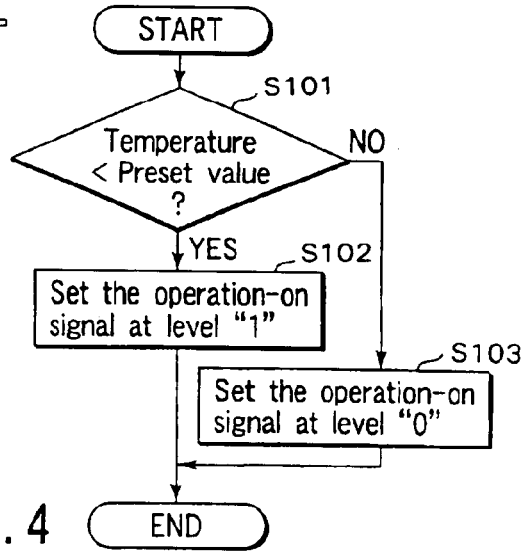
FIG. 4 is a flowchart explaining the operation of the print CPU provided in the embodiment.

The other input terminal of the AND circuit 307 receives the operation-on signal (at logic "1" level) from the print CPU 90. The operation-on signal supplied from the CPU 90 to the AND circuit 307 is at logic "1" level or logic "0" level in order to maintain the temperature of the heating roller 101 (i.e., the temperature detected by the sensor 301) at a preset temperature. As shown in the flowchart of FIG. 4, it is determined in Step S101 whether the temperature detected by the sensor 301 is lower than the preset temperature. If YES, the operation-on signal is set at logic "1" level in Step S102. If NO in Step S101, the operation-on signal is set at logic "0" level in Step S103.

The AND circuit 307 outputs the operation-on signal at logic "1" level when the output of the comparator 304 is at logic "1" level. The operation-on signal at logic "1" level is supplied to the IH CPU 215.

In the meantime, the output voltage of the current-detecting circuit 210 is input to the positive (+) input terminal of a comparator 401. The DC voltage Vd is applied to a series circuit that comprises resistors 402 and 403. A voltage generated across the resistor 403 is applied as reference voltage to the negative (−) input terminal of the comparator 401. The output of the comparator 401 is at logic "0" level as long as the output voltage of the current-detecting circuit 210 remains lower than the reference voltage. When the output voltage of the circuit 210 becomes equal to or higher than the reference voltage, the output of the comparator 401 rises to logic "1" level. The output of the comparator 401 is supplied to one input terminal of an AND circuit 404. The other input terminal of the AND circuit 404 receives an operation-on signal (at logic "1" level) supplied from the AND circuit 307 through an inverter 405.

The comparator 401, resistors 402 and 403, AND circuit 404, inverter 405 and switch 201 constitute a protection circuit 400. If the AND circuit 307 outputs no operation-on signal and the output of the inverter 405 therefore remains at logic "1" level, the output of the AND circuit 404 rises to logic "1" level when the current-detecting circuit 210 detects the input current and its output voltage rises to the reference voltage or any voltage higher than the reference voltage. The output of the AND circuit 404, which is at logic "1" level, opens the normally closed contacts 201*a* and 201*b* of the switch 201. As a result, the current path (power-supply line) to the commercially available power supply is electrically disconnected from to the high-frequency wave generating circuit.

How the fixing apparatus described above operates will be explained below.

The print CPU 90 outputs an operation-on signal at logic "1" level, which is supplied to the IH CPU 215 via the AND circuit 307. As long as the operation-on signal remains at logic "1" level, the IH CPU 215 keeps driving the drive circuit 207. Thus, the drive circuit 207 drives the high-frequency wave generating circuit, which generates power. The power excites the resonant circuit that comprises the coil 111 and capacitor 205. That is, a high-frequency current flows in the coil 111, which generates a high-frequency magnetic field. The high-frequency magnetic field induces an eddy current in the heating roller 101. The heating roller 101 generates Joule heat from the eddy current.

When the temperature sensor 301 detects that the temperature of the heating roller 101 becomes too high, the output of the comparator 304 acquires logic "1" level. At the same time the AND circuit 307 blocks the operation-on signal input from the print CPU 90. Therefore, the operation-on signal is not supplied to the IH CPU 215. The IH CPU 215 stops controlling the high-frequency wave generating circuit. The heating roller 101 becomes no longer heated too much.

The current-detecting circuit 210 detects the input current to the high-frequency wave generating circuit while the high-frequency wave generating circuit is operating. The circuit 210 generates a signal that represents the input current detected. The signal is supplied to the IH CPU 215. The IH CPU 215 determines the output of the coil 111 from the current that the circuit 210 has detected. The IH CPU 215 controls the high-frequency wave generating circuit to cause the output of the coil 111 to have a prescribed value.

The print CPU 90 monitors the output signal of the detector 301, which represents the temperature of the heating roller 102. Based on the magnitude of the output signal of the detector 301, the print CPU 90 keeps or stops outputting the operation-on signal to maintain the temperature of the heating roller 101 at a preset value. When the CPU 90 stops outputting the operation-on signal, the high-frequency wave generating circuit stops operating.

Nonetheless, the IH CPU 215 may malfunction to keep driving the high-frequency wave generating circuit, even if the print circuit 90 has stopped generating the operation-on signal. In this case, a current continues to flow from the commercially-available power supply to the high-frequency wave generating circuit. The current-detecting circuit 210 detects this current. The protection circuit 400 processes the output of the circuit 210 and the operation-on at logic "1" level, generating an output at logic "1" level. The output of the protection circuit 400, which is at logic "1" level, opens the normally-closed contacts 201*a* and 201*b*. As a result, the supply of a current to the high-frequency wave generating circuit is stopped. The high-frequency wave generating circuit is therefore immediately stopped.

As described above, the current-detecting circuit 210 detects whether the high-frequency wave generating circuit is unnecessarily operating while the operation-on signal remains at logic "0" level. The high-frequency wave generating circuit is immediately stopped before the heating roller 101 is heated to excess, when the circuit 210 detects an unnecessary operation of the high-frequency wave generating circuit. Thus, no thermal influence is imposed on the heating roller 101 or any component located near the roller 101.

Unlike the conventional fixing apparatus, the fixing apparatus according to the invention need not comprise a thermostat. Hence, no parts of the power line need to go around the heating roller 101. This ensures noise reduction and operation safety.

Moreover, the fixing apparatus can be manufactured at a relatively low cost. This is because the current-detecting circuit 210 is configured to detect not only a control current, but also an unnecessary operation of the high-frequency wave generating circuit.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fixing apparatus comprising:

a heating member to be rotated to fix toner images;

a coil which generates a high-frequency magnetic field to perform induction heating in the heating member;

a high-frequency wave generating circuit which operates with power supplied from a power supply and which outputs a high-frequency current to the coil for generating the high-frequency magnetic field;

a current-detecting unit which detects a current supplied from the power supply to the high-frequency wave generating circuit;

a control unit which drives the high-frequency wave generating circuit when an operation-on signal for initiating the induction heating acquires a first logic level and which stops the high-frequency wave generating circuit when the operation-on signal acquires a second logic level; and a protection circuit which controls supply of the current to the high-frequency wave generating circuit in accordance with the logic level of the operation-on signal and the magnitude of the current detected by the current-detecting unit.

2. The fixing apparatus according to claim 1, wherein the control unit detects an output of the coil from the current detected by the current-detecting unit, while the operation-on signal remains at the second logic level, and causes the high-frequency wave generating circuit to generate an output having a predetermined value.

3. The fixing apparatus according to claim 1, wherein the protection circuit stops supply of the current from the power supply to the high-frequency wave generating circuit when the operation-on signal acquires the second logic level.

4. The fixing apparatus according to claim 1, wherein the high-frequency wave generating circuit comprises a rectifying circuit which rectifies a voltage applied from the power supply, a capacitor which is connected to the coil and constituting a resonant circuit jointly with the coil, and a switching element which excites the resonant circuit.

5. The fixing apparatus according to claim 1, wherein the current-detecting unit comprises a voltage-lowering transformer having a primary winding connected to a current path of the high-frequency wave generating circuit, a rectifying circuit connected to a secondary winding of the voltage-lowering transformer and a serial circuit connected to an output terminal of the rectifying circuit and comprising a resistor and a smoothing capacitor, and outputs a direct-current voltage which corresponds to a current input from the power supply to the high-frequency wave generating circuit.

6. The fixing apparatus according to claim 1, wherein the protection circuit comprises a comparator which compares an output voltage of the current-detecting circuit with a predetermined reference voltage, an inverter which inverts a logic level of the operation-on signal, an AND circuit which receives the output of the inverter and the output of the comparator, and a switch which opens and closes a current path between the power supply and the high-frequency wave generating circuit in accordance with an output of the AND circuit.

7. The fixing apparatus according to claim 1, wherein the heating member is a hollow cylindrical heating roller, and the coil is provided in the heating roller.

8. A fixing apparatus comprising:

heating means to be rotated to fix toner images;

a coil which generates a high-frequency magnetic field to perform induction heating in the heating means;

high-frequency wave generating circuit which operates with power supplied from a power supply and which outputs a high-frequency current to the coil for generating the high-frequency magnetic field;

current-detecting means for detecting a current supplied from the power supply to the high-frequency wave generating means;

control unit means for driving the high-frequency wave generating means when an operation-on signal for initiating the induction heating acquires a first logic level and which stops the high-frequency wave generating means when the operation-on signal acquires a second logic level; and protection means for controlling supply of the current to the high-frequency wave generating means in accordance with the logic level of the operation-on signal and the magnitude of the current detected by the current-detecting means.

9. The fixing apparatus according to claim 8, wherein the control means detects an output of the coil from the current detected by the current-detecting means, while the operation-on signal remains at the second logic level, and causes the high-frequency wave generating means to generate an output having a predetermined value.

10. The fixing apparatus according to claim 8, wherein the protection means stops supply of the current from the power supply to the high-frequency wave generating means when the operation-on signal acquires the second logic level.

11. The fixing apparatus according to claim 8, wherein the high-frequency wave generating means comprises a rectifying circuit which rectifies a voltage applied from the power supply, a capacitor which is connected to the coil and constituting a resonant circuit jointly with the coil, and a switching element which excites the resonant circuit.

12. The fixing apparatus according to claim 8, wherein the current-detecting means comprises a voltage-lowering transformer having a primary winding connected to a current path of the high-frequency wave generating circuit, a rectifying circuit connected to a secondary winding of the voltage-lowering transformer and a serial circuit connected to an output terminal of the rectifying circuit and comprising a resistor and a smoothing capacitor, and outputs a direct-current voltage which corresponds to a current input from the power supply to the high-frequency wave generating means.

13. The fixing apparatus according to claim 8, wherein the protection means comprises a comparator which compares an output voltage of the current-detecting means with a predetermined reference voltage, an inverter which inverts a logic level of the operation-on signal, an AND circuit which receives the output of the inverter and the output of the comparator, and a switch which opens and closes a current path between the power supply and the high-frequency wave generating means in accordance with an output of the AND circuit.

14. The fixing apparatus according to claim 8, wherein the heating means is a hollow cylindrical heating roller, and the coil is provided in the heating roller.

* * * * *